US010099912B2

(12) United States Patent
You et al.

(10) Patent No.: US 10,099,912 B2
(45) Date of Patent: Oct. 16, 2018

(54) LIQUID SUPPLYING DEVICE AND PHOTORESIST COATING EQUIPMENT

(71) Applicants: BOE TECHNOLOGY GROUP CO., LTD., Beijing (CN); BEIJING BOE DISPLAY TECHNOLOGY CO., LTD., Beijing (CN)

(72) Inventors: Zhenqi You, Beijing (CN); Jianfeng Wang, Beijing (CN); Lei Zhu, Beijing (CN); Lianjie Lin, Beijing (CN); Kaimin Wu, Beijing (CN)

(73) Assignees: BOE TECHNOLOGY GROUP CO., LTD. (CN); BEIJING BOE DISPLAY TECHNOLOGY CO., LTD. (CN)

( * ) Notice: Subject to any disclaimer, the term of this patent is extended or adjusted under 35 U.S.C. 154(b) by 134 days.

(21) Appl. No.: 14/495,972

(22) Filed: Sep. 25, 2014

(65) Prior Publication Data

US 2015/0345709 A1 Dec. 3, 2015

(30) Foreign Application Priority Data

May 30, 2014 (CN) ..... 2014 2 0287261 U

(51) Int. Cl.
*B67D 1/08* (2006.01)
*B65D 83/32* (2006.01)
*F17D 1/08* (2006.01)

(52) U.S. Cl.
CPC ..... *B67D 1/0802* (2013.01); *B65D 83/32* (2013.01); *F17D 1/08* (2013.01); *Y10T 137/86236* (2015.04); *Y10T 137/86348* (2015.04)

(58) Field of Classification Search
CPC .... B05B 15/005; B65D 83/32; B67D 1/0802; Y10T 137/86348; Y10T 137/86236
See application file for complete search history.

(56) References Cited

U.S. PATENT DOCUMENTS 2,437,817 A * 3/1948 Hennessy ..... B61F 17/24 384/169
3,352,125 A * 11/1967 Beatenbough ..... F25B 41/062 251/321
4,694,975 A * 9/1987 Hagan ..... B67D 1/0456 215/4
5,540,355 A * 7/1996 Hancock ..... B67D 1/04 222/146.6
6,357,494 B1 * 3/2002 Hahn ..... B67D 1/0802 141/367

(Continued)

FOREIGN PATENT DOCUMENTS

JP 61171611 A * 8/1986 ..... B60K 15/077

*Primary Examiner* — Atif Chaudry
(74) *Attorney, Agent, or Firm* — Brooks Kushman P.C.

(57) ABSTRACT

The present invention provides a liquid supplying device and a photoresist coating equipment. The liquid supplying device i A liquid supplying device, comprising: a tank for storing liquid; and a liquid transfer pipe inserted into the tank, and an elastic retractable structure is provided on at least one portion of the liquid transfer pipe, and a pipe end portion of the liquid transfer pipe in the tank is always contacted with and pressed against an inner wall of the tank. In the present invention, the liquid is able to be output continuously, and a problem of the prior art in which the liquid stored in the tank cannot be used sufficiently can be avoided.

9 Claims, 5 Drawing Sheets

(56) References Cited

U.S. PATENT DOCUMENTS

| | | | | |
|---|---|---|---|---|
| 6,817,485 | B2 * | 11/2004 | Kawai | B65D 1/0215 222/1 |
| 2002/0070244 | A1 * | 6/2002 | Simard | B05B 15/005 222/382 |

* cited by examiner (Prior art )

LIQUID SUPPLYING DEVICE AND PHOTORESIST COATING EQUIPMENT

CROSS-REFERENCE TO RELATED APPLICATION

This application claims priority to Chinese Utility model Application No. 201420287261.1 filed on May 30, 2014, entitled "Liquid supplying device and photoresist coating equipment", the disclosures of which are incorporated in their entirety by reference herein.

TECHNICAL FIELD

The present invention relates to a field of display panel manufacturing technology, in particular to a liquid supplying device and a photoresist coating equipment.

BACKGROUND

In a manufacturing process of a crystal display panel, many steps relate to transferring and supplying of liquid material, for example, photoresist coating and developer spraying. Thus, transferring and supplying of liquid material are essential steps in a manufacturing process of a crystal display panel.

FIG. 1 is a schematic diagram showing a photoresist supplying structure of a photoresist coating equipment according to prior art. The photoresist supplying structure includes a tank 1 for storing photoresist. Usually, the tank 1 is made of polyethylene (PE) material. Two communication pipes are provided on an end cover of the tank 1, and are inserted into the tank 1. A first pipe 2 of the two communication pipes is a stainless steel pipe, and extends to a position above a bottom of the tank 1, and transfers the photoresist to outside. A second pipe 3 of the two communication pipes is a gas inlet pipe, and injects pressured gas having a predetermined pressure to the inside portion of the tank 1. During a photoresist coating, based on a pressure difference principle, the second pipe 3 injects gas to the inside portion of the tank 1 to make an inside pressure of the tank 1 higher than an outside pressure, so that the photoresist stored in the tank 1 is output through the first pipe 2 and is provided to the photoresist coating equipment.

However, in an actual photoresist coating technology, when the second pipe 3 injects gas into the tank 1, the pressure of the gas causes a deformation of the tank. When the deformation of the tank 1 occurs, a deformation amount in a length is greater than a deformation amount in a width. Thus, as shown in FIG. 2, a distance between the first pipe 2 and the bottom of the tank 1 increases. In this structure, the photoresist remained at a bottom portion of the tank 1 cannot be absorbed by the first pipe 2 and cannot be used, and this structure causes a waste of the material.

SUMMARY

A purpose of a technical solution of the present invention is to provide a liquid supplying device and a photoresist coating equipment, which solve a problem existing in transferring and supplying of liquid material in the prior art. The problem is that the liquid material left at the bottom portion of the tank cannot be sufficiently used.

The present invention provides a liquid supplying device. The liquid supplying device includes a tank for storing liquid and a liquid transfer pipe inserted into the tank. An elastic retractable structure is provided on at least one portion of the liquid transfer pipe, and a pipe end portion of the liquid transfer pipe in the tank is always contacted with and pressed against an inner wall of the tank.

Further, in the liquid supplying device, a side notch or notches are provided at the pipe end portion and the liquid flows into the liquid transfer pipe through the side notch(es).

Further, in the liquid supplying device, the elastic retractable structure includes a first end and a second end. The first end is positioned farther from the pipe end portion compared with the second end, and a distance from the first end to the pipe end portion is equal to or less than a sum of a length of the elastic retractable structure in a free retractable state and a distance from the second end to the pipe end portion.

Further, in the liquid supplying device, the elastic retractable structure is provided at one end of the liquid transfer pipe in the tank, and an end portion of the elastic retractable structure is used as said pipe end portion.

Further, in the liquid supplying device, the elastic retractable structure is provided at a middle region of the liquid transfer pipe in the tank, and an end portion of the liquid transfer pipe is used as said pipe end portion.

Further, in the liquid supplying device, the liquid transfer pipe includes a pipe body connected with the elastic retractable structure. The elastic retractable structure includes a first retractable portion that extends in a direction approaching to the inner wall of the tank and a second retractable portion that is provided around an outside of a portion of the pipe body or is provided in a portion of the pipe body. The second retractable portion is airtightly connected with the pipe body.

Further, in the liquid supplying device, the first retractable portion is a spring; and the second retractable portion is a retractable pipe. An upper end of the retractable pipe is airtightly connected with the pipe body and an upper end of the spring is fixed to an outer surface of the pipe body. A lower end of the retractable pipe is used as said pipe end portion.

Further, in the liquid supplying device, the liquid transfer pipe includes a pipe body with two sections respectively connected with the elastic retractable structure. The elastic retractable structure includes: a spring; and a retractable pipe disposed inside the spring. The two ends of the retractable pipe is respectively airtightly connected with two sections of the pipe body; and two ends of the spring is respectively fixed to outer surface of two sections of the pipe body.

Further, in the liquid supplying device, the retractable pipe is provided by a corrugated pipe.

Further, the liquid supplying device further includes a gas transfer pipe for injecting gas having a predetermined pressure to the inside portion of the tank. The elastic retractable structure of the liquid transfer pipe is in a pressed state during an operation of the liquid supplying device so that the pipe end portion provided in the tank is always contacted with and pressed against with the inner wall of the tank.

The present invention further provides a photoresist coating equipment. The photoresist coating equipment includes a liquid supplying device. The liquid supplying device includes a tank for storing liquid; and a liquid transfer pipe inserted into the tank. An elastic retractable structure is provided on at least one portion of the liquid transfer pipe, and a pipe end portion of the liquid transfer pipe in the tank is always contacted with and pressed against an inner wall of the tank. A photoresist is stored in the tank. The liquid transfer pipe and the elastic retractable structure is made of corrosion resistant material, such as, corrosion resistant metal material.

Further, in the photoresist coating equipment, a side notch or notches are provided at the pipe end portion and the liquid flows into the liquid transfer pipe through the side notch(es).

Further, in the photoresist coating equipment, the elastic retractable structure includes a first end and a second end. The first end is positioned farther from the pipe end portion compared with the second end, and a distance from the first end to the pipe end portion is equal to or less than a sum of a length of the elastic retractable structure in a free retractable state and a distance from the second end to the pipe end portion.

Further, in the photoresist coating equipment, the elastic retractable structure is provided at one end of the liquid transfer pipe in the tank, and an end portion of the elastic retractable structure is used as said pipe end portion.

Further, in the photoresist coating equipment, the elastic retractable structure is provided at a middle region of the liquid transfer pipe in the tank, and an end portion of the liquid transfer pipe is used as said pipe end portion.

Further, in the photoresist coating equipment, the liquid transfer pipe includes a pipe body connected with the elastic retractable structure. The elastic retractable structure includes a first retractable portion that extends in a direction approaching to the inner wall of the tank and a second retractable portion that is provided around an outside of a portion of the pipe body or is provided in a portion of the pipe body. The second retractable portion is airtightly connected with the pipe body.

Further, in the photoresist coating equipment, the first retractable portion is a spring; and the second retractable portion is a retractable pipe. An upper end of the retractable pipe is airtightly connected with the pipe body and an upper end of the spring is fixed to an outer surface of the pipe body. A lower end of the retractable pipe is used as said pipe end portion.

Further, in the photoresist coating equipment, the liquid transfer pipe includes a pipe body with two sections respectively connected with the elastic retractable structure. The elastic retractable structure includes: a spring; and a retractable pipe disposed inside the spring. The two ends of the retractable pipe is respectively airtightly connected with two sections of the pipe body; and two ends of the spring is respectively fixed to outer surface of two sections of the pipe body.

Further, in the photoresist coating equipment, the retractable pipe is provided by a corrugated pipe.

Further, in the photoresist coating equipment, the liquid supplying device further includes a gas transfer pipe for injecting gas having a predetermined pressure to the inside portion of the tank. The elastic retractable structure of the liquid transfer pipe is in a pressed state during an operation of the liquid supplying device so that the pipe end portion provided in the tank is always contacted with and pressed against with the inner wall of the tank.

The technical solution according to at least one of the above embodiments of the present invention provides the following advantages.

In the present invention, at least one portion of the liquid transfer pipe is formed as the elastic retractable structure. Thus, when the tank deforms, the elastic retractable structure elastically extends so that the pipe end portion is always contacted with the inner wall of the tank in a pressed manner, and the pipe end portion is always positioned under a liquid level of the liquid stored in the tank. Thus, the liquid supplying device and the photoresist coating equipment according to the present invention enable continuous output of the liquid and avoid a problem existing in the prior art in which the liquid material left at a bottom portion of the tank cannot be sufficiently used.

DETAILED DESCRIPTION

To make the objects, the technical solutions and the advantages of the present invention more apparent, the following will describe the present invention with reference to embodiments and accompanying drawings.

A liquid supplying device according to an embodiment of the present invention includes a tank for storing liquid and a liquid transfer pipe inserted into the tank. At least a part of the liquid transfer pipe is formed as an elastic retractable structure, and a pipe end portion of the liquid transfer pipe, which is positioned in the tank, is contacted with and pressed against an inner wall of the tank.

In the liquid supplying device, at least a part of the liquid transfer pipe is fainted as the elastic retractable structure, and the pipe end portion of the liquid transfer pipe is contacted with and pressed against the inner wall of the tank. With this configuration, during transferring of the liquid, even when the tank deforms and the deformation causes the liquid transfer pipe to move up relative to a liquid level of the liquid, the liquid transfer pipe extends under a restoring force of the elastic retractable structure and maintains the pipe end portion contacting with the inner wall of the tank in a pressed manner. Thus, the pipe end portion is always positioned under the liquid level of the liquid stored in the tank. Accordingly, the liquid supplying device enables continuous output of the liquid and avoids a problem existing in the prior art in which the liquid material left at a bottom portion of the tank cannot be sufficiently used.

A person skilled in the art should know that, usually, the liquid transfer pipe is vertically inserted to the inside portion of the tank. In this case, the liquid transfer pipe extends until that the pipe end portion in the tank is contacted with and pressed against a bottom surface of the tank.

In order to further ensure that the liquid stored in the tank smoothly flows into the liquid transfer pipe, a side notch may be provided at the pipe end portion so that the liquid flows into the liquid transfer pipe through the side notch.

First Embodiment

Figure 1:
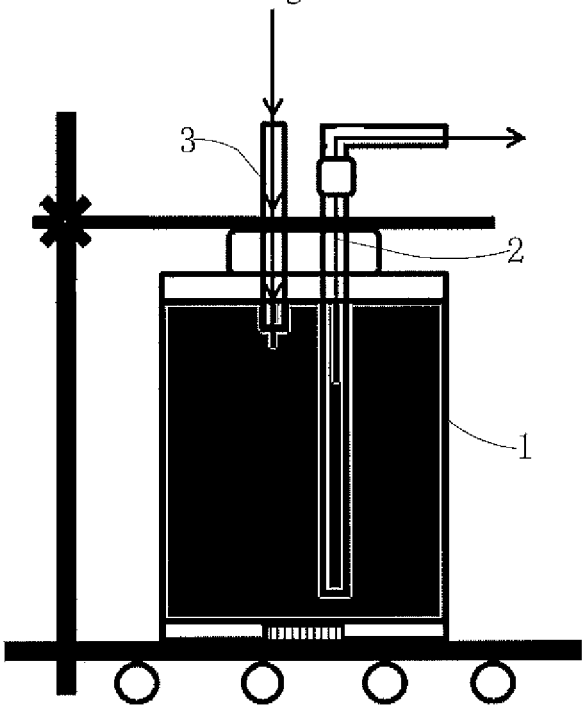
FIG. 1 is a schematic diagram showing a first state of a photoresist supplying structure according to a prior art when the photoresist supplying structure is in use.
Figure 2:
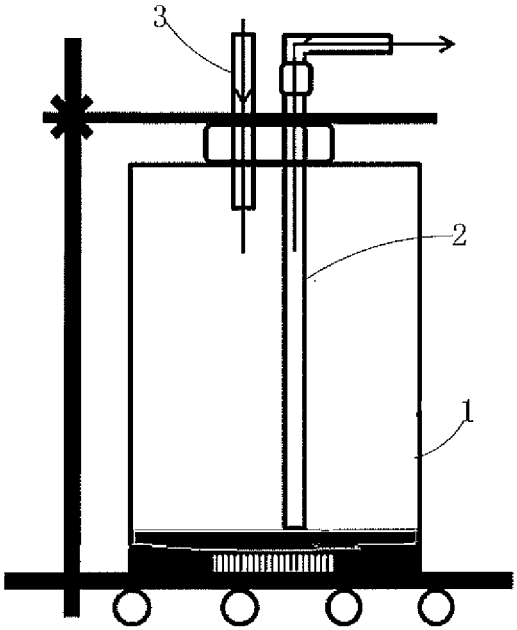
(Prior art ) Fig 2
FIG. 2 is a schematic diagram showing a second state of the photoresist supplying structure according to the prior art when the photoresist supplying structure is in use.
Figure 3:
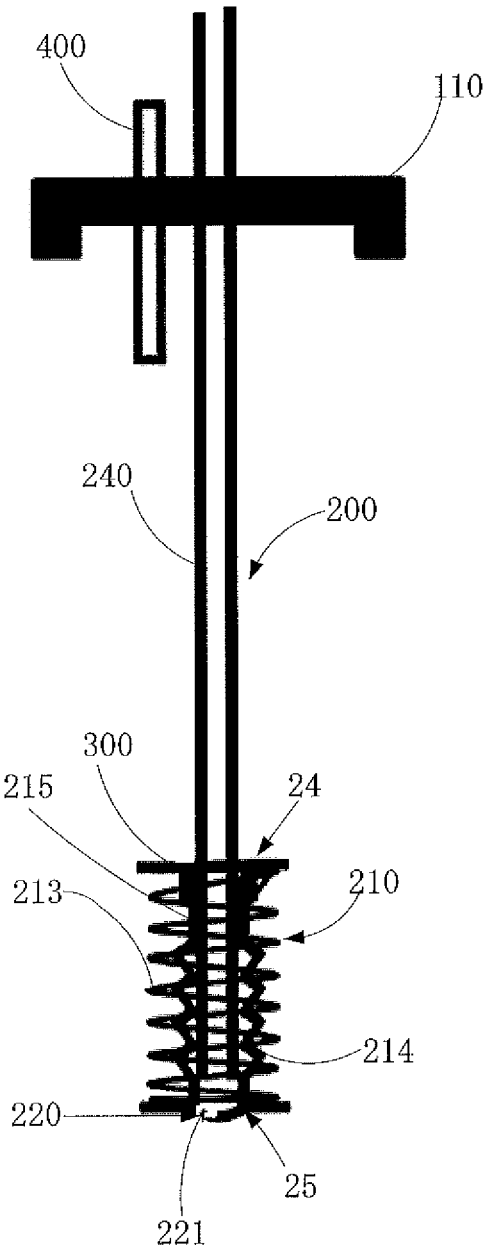
FIG. 3 is a schematic diagram partially showing a configuration of a liquid supplying device according to a first embodiment of the present invention.
Figure 4:
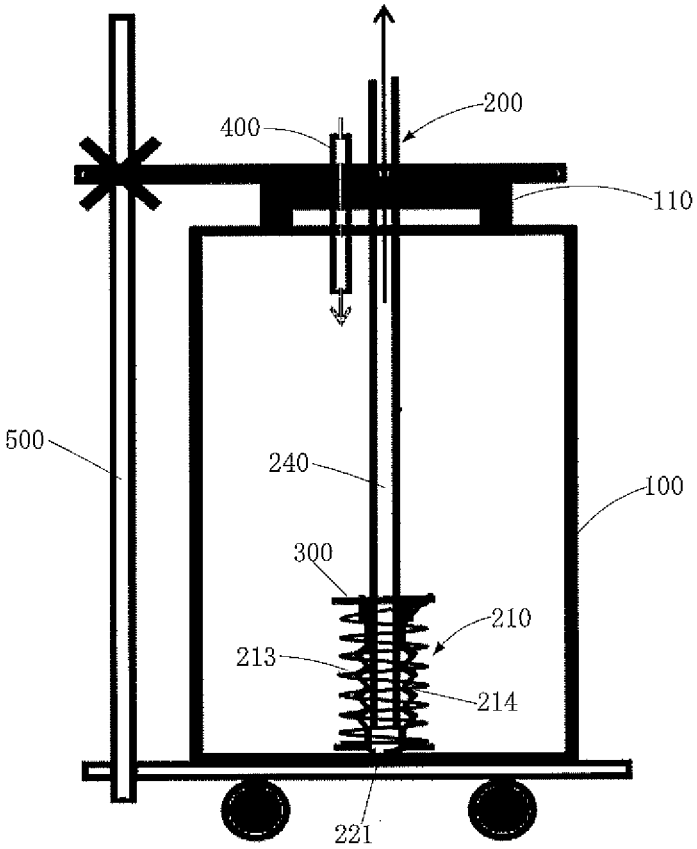
FIG. 4 is a schematic diagram showing a configuration the liquid supplying device according to the first embodiment of the present invention when the liquid supplying device is in a first state.
Figure 5:
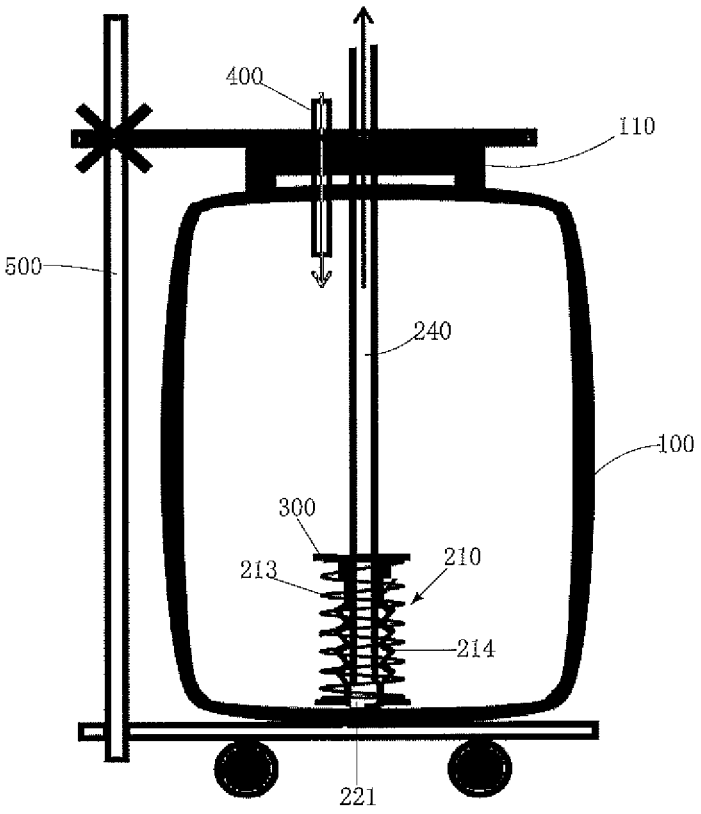
FIG. 5 is a schematic diagram showing a configuration the liquid supplying device according to the first embodiment of the present invention when the liquid supplying device is in a second state.

FIG. 3 is a diagram partially showing a configuration of a liquid supplying device according to a first embodiment of the present invention. FIG. 4 and FIG. 5 are diagrams showing the liquid supplying device working in different states. In the first embodiment, a configuration of the liquid supplying device used for transferring photoresist as an example. The liquid transferred by the liquid supplying device is not limited to the photoresist.

As shown in FIG. 3 and FIG. 4, the liquid supplying device according to the first embodiment includes a tank 100, a cover 110 airproofly covered on the tank 100, and a liquid transfer pipe 200 that penetrates the cover 110 via a through hole formed on the cover 110 and inserts into the tank 100. In the first embodiment, an end of the liquid transfer pipe 200 in the tank 100 is formed as an elastic retractable structure 210. The end of the elastic retractable structure 210 is the end portion 220 of the liquid transfer pipe 200.

Specifically, as shown in FIG. 3, the liquid transfer pipe 200 includes a pipe body 240 connected with the elastic retractable structure 210. The elastic retractable structure 210 includes a retractable pipe 214 connected with the pipe body 240. In FIG. 3, the retractable pipe 214 is provided around a lower portion of the pipe body 240. An upper end of the retractable pipe 214 is airtightly connected with an outer surface of the pipe body 240. A lower end of the retractable pipe 214 extends lower than a lower end of the pipe body 240 to form the pipe end portion 220. An entire length of the retractable pipe 214 is set so that, when the cover 110 is covered on the tank 100, the pipe end portion 220 is contacted with the bottom surface of the tank 100 and the retractable pipe 214 is compressed at a predetermined level.

Alternatively (not shown in the drawings), the upper end of the retractable pipe 214 may insert into the pipe body, and is airtightly connected on an inner surface of the pipe body 240. The lower end of the retractable pipe 214 may extend lower than the lower end of the pipe body 240, and forms the pipe end portion 220. An entire length of the retractable pipe 214 may be set so that, when the cover 110 is covered on the tank 100, the pipe end portion 220 is contacted with the bottom surface of the tank 100 and the retractable pipe 214 is compressed at a predetermined level.

An amount of the compression may be predetermined based on the deformation amount of the tank during the working state.

In the first embodiment, a distance from the first end 24 (upper end) of the elastic retractable structure 210 to the bottom end is S (not shown in the drawings), and a length of the elastic retractable structure 210 in a free state is L (not shown in the drawings). In order that the pipe end portion 220 of the retractable pipe 214 is contacted with the bottom surface of the tank 100, specifically, the distance S and the length L should satisfy a relationship: $S \leq L$. That is, when the liquid transfer pipe 200 is inserted into the tank 100, the elastic retractable structure 210 is in a compressed state. When the deformation of the tank 100 causes the liquid transfer pipe 200 to move in an upper direction, the liquid transfer pipe 200 may be separated from the bottom surface of the tank 10 during the movement. At this time, the elastic retractable structure 210 gradually extends, and may extend to a maximum length in the free retractable state. During this process, since the elastic retractable structure 210 extends, the distance S is always equal to or less than the length L. That is, the pipe end portion 220 is maintained to be contacted with the bottom surface of the tank 100.

Preferably, the retractable pipe 214 may be made integrately. The retractable pipe 214 may be provided by a corrugated pipe as shown in FIG. 3, and has a straight pipe portion having a relatively short length at the lower end.

In the first embodiment, as one example, the elastic retractable structure 210 includes a spring 213 and the retractable pipe 214 as shown in FIG. 3. The retractable 214 is provided in the spring 213 in a longitudinal direction of the spring 213. The pipe body 240 is inserted into the retractable pipe 214. A sealing ring 215 is provided between an upper end of the retractable pipe 214 and the pipe body 240 so that the retractable pipe 214 is airtightly connected with the pipe body 240. With this configuration, leakage of liquid to be transferred can be avoided from a connection portion between the retractable pipe 214 and pipe body 240. An upper end of the spring 213 is fixed to an outer surface of the pipe body 240. A lower end of the spring 213 is preferably provided on the same horizontal plane with the pipe end portion 220. With this configuration, when the spring 213 is compressed, the retractable pipe 214 provided in the spring is also compressed. The lower end of the spring 213 may be provided lower or higher than the pipe end portion 220 if only the spring 213 and the retractable pipe 214 are always contacted with the bottom surface of the tank 100 during mounting process and working process.

The elastic retractable structure 210 according to this configuration uses the retractable pipe 214 to achieve a pipe connection between the pipe body 240 and the elastic retractable structure 210. And the spring 213 is helpful to maintain the parameter of the elastic retractable structure 210 in the tank 100 satisfy $S \leq L$. In addition, the spring 213 makes the elastic retractable structure 210 have a predetermined rigidity. Thus, the pipe end portion 220 is able to maintain a good contact state with the bottom surface of the tank 100.

In the present embodiment, a support 300 is fixed to an outer surface of the pipe body 240 and the spring 213 is fixed to the support 300. Alternatively, the spring 213 can be fixed to the pipe body 240 in different manners.

In the preferred embodiment shown in FIG. 3, the elastic retractable structure 210 has a solid stable structure. The pipe end portion 220 can be always in the contacted state with the bottom surface of the tank 100 by the restoring action of the spring 213 and the retractable pipe 214.

In a modification of the present embodiment, the spring 213 may be omitted. That is, the pipe end portion 220 is always maintained in a contacted state with the bottom surface of the tank 100 only by the retractable pipe 214.

In order that the photoresist stored in the tank 100 can be sufficiently injected to the liquid transfer pipe 200, a side notch 221 may be provided at the pipe end portion 220 of the elastic retractable structure 210.

Further, in order to avoid a corrosion of the liquid transfer pipe 200 by the photoresist, both the pipe body 240 and the elastic retractable structure 210 may be made of corrosion resistant metal material.

Alternatively, the material of the retractable pipe may be the same with the material of the pipe body. In this case, the retractable pipe is configured as an elastic corrugated pipe, and the pipe body 240 is configured as a non-elastic pipe.

Alternatively, the material of the retractable pipe may be different from the material of the pipe body. In this case, the material of the retractable pipe is elastic material, and the material of the pipe body 240 is non-elastic material. Alternatively, an elasticity of the material of the pipe body is lower than an elasticity of the material of the retractable pipe.

As shown in FIG. 4 and FIG. 5, the first embodiment is applied to a supplying device that transfers the photoresist.

The supplying device may further include a gas transfer pipe that injects gas having a predetermined pressure into the inside portion of the tank 100. A person skilled in the art should understand that the liquid supplying device for transferring photoresist may further include a support stand 500 that fixes the tank 100.

As shown in FIG. 4, when coating photoresist using the liquid supplying device, first, the liquid transfer pipe 200 and the gas transfer pipe 400 are respectively inserted into the tank 100 through two through holes formed on the cover 110. It is sealed at the position of through holes. The pipe end portion 220 of the liquid transfer pipe 200 is contacted with and pressed against the bottom surface of the tank 100 so that the elastic retractable structure 210 is compressed and deformed. Then, the gas having a predetermined pressure is injected into the tank through the gas transfer pipe 400 so that the photoresist stored in the tank 100 flows into the liquid transfer pipe 200 under the pressure of the gas. The photoresist moves upward along the liquid transfer pipe 200 and flows to an outside of the tank 100. As shown in FIG. 5, during a coating of the photoresist, the tank 100 deforms caused by the pressure of the gas injected through the gas transfer pipe 400, and causes the liquid transfer pipe 200 to move in the upward direction together with the cover 110. At this time, the pipe end portion 220 of the liquid transfer pipe 200 extends under an elastic restoring force of the elastic retractable structure 210, and the pipe end portion 220 is always maintained in a contacted state with the bottom surface of the tank 100.

Second Embodiment

Figure 6:
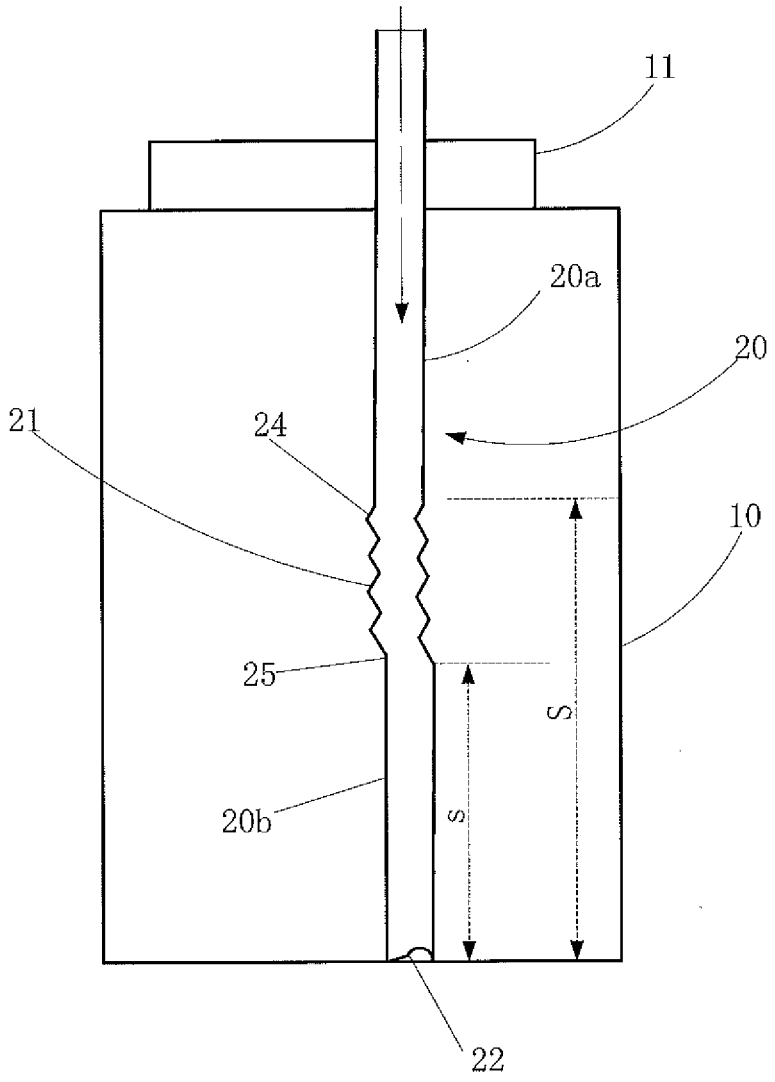
FIG. 6 is a schematic diagram showing configuration of a liquid supplying device according to a second embodiment of the present invention.

FIG. 6 is a diagram showing a configuration of a liquid supplying device according to a second embodiment of the present invention. The liquid supplying device includes a tank 10, a cover 11 covered on the tank 10, and a liquid transfer pipe 20 that penetrates the cover 11 via a through hole formed on the cover 11 and inserts into the tank 10.

In the second embodiment of the present invention, an elastic retractable structure 21 is formed on a middle region of the liquid transfer pipe 20 and the elastic retractable structure 21 is elastically extendable or elastically compressible in a longitudinal direction of the liquid transfer pipe 20. The liquid transfer pipe 20 connected with two ends of the elastic retractable structure 21 has no elastic deformation property, and referred as pipe bodies 20*a* and 20*b*. The pipe end portion 22 of the pipe body 20*b* is contacted with the bottom surface of the tank 10.

In the second embodiment of the present invention, a preferred structure of the elastic retractable structure 21 may be configured similar to the elastic retractable structure 210 shown in FIG. 3. In the present embodiment, the two ends of the retractable pipe are airtightly connected with the pipe body 20*a* and the pipe body 20*b*, respectively.

When the cover is covered on the tank, the lower end of the pipe body 20*b* is contacted with the bottom surface of the tank and the elastic retractable structure 21 is compressed by a predetermined level. A compression amount may be defined based on a deformation amount of the tank during using of the device.

The elastic retractable structure 21 may be provided by an elastic corrugated pipe. Alternatively, as shown in FIG. 3, a spring may be provided around outer surface of the corrugated pipe. Two ends of the spring may be fixed to the pipe body 20*a* and the pipe body 20*b*, respectively.

Specifically, as shown in FIG. 6, the elastic retractable structure 21 includes a first end 24 and a second end 25. The first end 24 is positioned farther from the pipe end portion 22 compared with the second end 25. As shown in FIG. 6, a distance from the first end 24 to the pipe end portion 22 is defined as S, and a distance from the second end 25 to the pipe end portion 22 is defined as s. Further, a length of the elastic retractable structure 21 in the free retractable state is defined as L. In order that the pipe end portion 22 is maintained in a contacted state with the bottom surface of the tank 10, the distances S, s and the length L should satisfy the formula: $S \leq s+L$. That is, when the liquid transfer pipe 20 is inserted into the tank 10, the pipe end portion 22 of the pipe body 20*b* is pressed against the bottom surface of the tank 10 and the elastic retractable structure 21 is compressed. When the deformation caused by the expansion of the tank 10 cases the liquid transfer pipe 20 to move in the upward direction, and during the movement of the pipe end portion 22 together with the liquid transfer pipe 20, the pipe end portion 22 may be separated from the bottom surface of the tank 10. At this time, the elastic retractable structure 21 may extend until the maximum length in the free retractable state. During this process, since the elastic retractable structure 21 extends and the relationship $S \leq s+L$ is satisfied, the pipe end portion 22 can be always maintained in a contacted state with the bottom surface of the tank 10.

In order that the photoresist stored in the tank is sufficiently injected into the liquid transfer pipe 20, the side notch 2 may be provided at the pipe end portion 22.

A person skilled in the art could understand that an expansion deformation amount of the tank 10 is usually has a small value, and a compression amount of the elastic retractable structure 21 may completely ensure that the pipe end portion 10 is always contacted with the bottom surface of the tank 10.

The material of the liquid transfer pipe 20 including the elastic retractable structure 21 may be defined based on a type of the liquid to be stored in the tank 10. When the tank 10 stores non-corrosive liquid, the liquid transfer pipe 20 may be made of plastic material. When the tank 10 stores corrosive liquid, such as the photoresist, the liquid transfer pipe 20 may be made of corrosion resistant metal material or other corrosion resistant material.

With the liquid supplying device according to the foregoing embodiments of the present invention, the pipe end portion of the liquid transfer pipe is always positioned under the liquid level of the liquid stored in the tank. Thus, the liquid supplying device enables a continuous output of the liquid, and avoids a problem existing in the prior art in which the liquid material left at a bottom portion of the tank cannot be sufficiently used.

Another aspect of the present invention provides a photoresist coating equipment including the above-described liquid supplying device. The liquid stored in the tank of the liquid supplying device is photoresist. In order to avoid corrosion, the liquid transfer pipe and the elastic retractable structure are made of corrosion resistant material, such as, corrosion resistant metal material.

A person skilled in the art should understand a setting method of the above-described liquid supplying device that supplies the photoresist in the photoresist coating equipment. Thus, detailed description is omitted.

The liquid supplying device describe above is used for supplying the photoresist. Alternatively, the liquid supplying device may also be used for supplying other types of liquid, such as developer or the like.

Preferred embodiments of the present invention are described. It should be noted for a person skilled in the art of the present invention, without departing from a principle and a premise of the present invention, various modifications and improvements can be made, and these improvements and modifications should also be considered to be included within a scope of the present invention.

What is claimed is:

1. A photoresist coating equipment comprising: a support stand and a liquid supplying device secured on the support stand;

wherein the liquid supplying device comprises: a tank for storing photoresist; a cover covered on the tank; a gas transfer pipe extending through a first position of the cover for injecting compressed gas to an inside portion of the tank; and a liquid transfer pipe;

wherein the liquid transfer pipe comprises:

a pipe body extending through a second position of the cover;

a support directly fixed to an outer surface of the pipe body and located within the tank;

a retractable pipe located within the tank and having an upper end connected with the pipe body and a lower end in direct contact with a bottom of the tank;

a sealing ring between the upper end of the retractable pipe and the pipe body;

a spring surrounding the retractable pipe and located within the tank;

wherein the lower end of the retractable pipe is provided with a flange located at a lower end of the liquid transfer pipe; an upper end of the spring is secured on the support that is directly fixed to the outer surface of the pipe body; a lower end of the spring abuts against on the flange;

wherein the spring is compressed between the flange and the support that is directly fixed to the outer surface of the pipe body; and the retractable pipe is compressed between the bottom of the tank and the pipe body;

wherein the sealing ring is below the support that is directly fixed to the outer surface of the pipe body.

2. The photoresist coating equipment according to claim 1, wherein a distance between the bottom of the tank and the support that is directly fixed to the outer surface of the pipe body is changed from a first value to a second value when the tank is deformed by the compressed gas from the gas transfer pipe; the second value is larger than the first value, and the second value is smaller than a sum of a free length of the spring and a thickness of the flange.

3. The photoresist coating equipment according to claim 1, wherein the lower end of the spring is in an indirect contact with the bottom of the tank.

4. The photoresist coating equipment according to claim 1, wherein a distance between the bottom of the tank and the support that is directly fixed to the outer surface of the pipe body is always smaller than a sum of a free length of the spring and a thickness of the flange.

5. The photoresist coating equipment according to claim 1, wherein the first position is separated from the second position.

6. The photoresist coating equipment according to claim 1, wherein the retractable pipe is a corrugated pipe made of corrosion resistant material.

7. The photoresist coating equipment according to claim 1, wherein a side notch is provided in the lower end of the retractable pipe.

8. The photoresist coating equipment according to claim 1, wherein the flange horizontally and outwardly extends from the lower end of the retractable pipe.

9. The photoresist coating equipment according to claim 1, wherein the sealing ring is between the flange and the support that is directly fixed to the outer surface of the pipe body.

* * * * *